US007192338B2

(12) United States Patent
Kausch et al.

(10) Patent No.: US 7,192,338 B2
(45) Date of Patent: Mar. 20, 2007

(54) FIXING DEVICE, CLAMPING SYSTEM AND ALLOCATED TOOL

(75) Inventors: Manfred Kausch, Wermelskirchen (DE); Hans-Josef Kulmer, Remscheid (DE); Torsten Sommer, Remscheid (DE)

(73) Assignee: Bruno Schmitz Schleifmittelwerk GmbH, Remscheid (DE)

( * ) Notice: Subject to any disclaimer, the term of this patent is extended or adjusted under 35 U.S.C. 154(b) by 0 days.

(21) Appl. No.: 10/481,865

(22) PCT Filed: Mar. 2, 2002

(86) PCT No.: PCT/DE02/00746

§ 371 (c)(1),
(2), (4) Date: Jun. 9, 2004

(87) PCT Pub. No.: WO03/000463

PCT Pub. Date: Jan. 3, 2003

(65) Prior Publication Data

US 2005/0075059 A1 Apr. 7, 2005

(30) Foreign Application Priority Data

Jun. 21, 2001 (WO) ..... PCT/DE01/02268

(51) Int. Cl.
*B24B 23/00* (2006.01)
*B24B 27/08* (2006.01)
*B24D 17/00* (2006.01)

(52) U.S. Cl. ..... 451/359; 451/358; 451/514; 451/515; 451/516; 451/517; 451/518; 451/519

(58) Field of Classification Search ..... 451/358, 451/359, 514–519
See application file for complete search history.

(56) References Cited

U.S. PATENT DOCUMENTS

| | | | | |
|---|---|---|---|---|
| 2,550,768 | A * | 5/1951 | Burleigh | 451/294 |
| 3,623,281 | A * | 11/1971 | Moffat | 451/509 |
| 6,523,214 | B1 * | 2/2003 | Kaiser | 15/230 |
| 6,786,811 | B2 * | 9/2004 | Krondorfer et al. | 451/342 |
| 2003/0104773 | A1 | 6/2003 | Krondorfer et al. | 451/342 |

FOREIGN PATENT DOCUMENTS

| | | |
|---|---|---|
| EP | 0 904 896 | 3/1999 |
| EP | 0904896 A2 * | 3/1999 |

* cited by examiner

*Primary Examiner*—Lee D. Wilson
*Assistant Examiner*—Bryan Muller
(74) *Attorney, Agent, or Firm*—Grossman Tucker Perreault & Pfleger, PLLC

(57) ABSTRACT

A tool for co-operating with a fixing device wherein the tool comprises a tool body in the form of a circular disk, with a central opening and a radially inwardly facing locking surface. The fixing device comprises at least one radially outwardly facing projection of a locking element, which can be actuated manually and with which the fixing device can be releasably connected to the tool. In the locking position the at least one radially outwardly facing projection of the fixing device engages over the inwardly facing locking surface of the tool. The tool body is axially secured and held non-rotatably relative to the fixing device. The at least one radially outwardly facing projection of the fixing device and a support for the tool are arranged axially displaceably relative to each other, wherein the axial displacement travel is blockable by a centrifugal force device.

17 Claims, 9 Drawing Sheets

FIXING DEVICE, CLAMPING SYSTEM AND ALLOCATED TOOL

Figure 1:
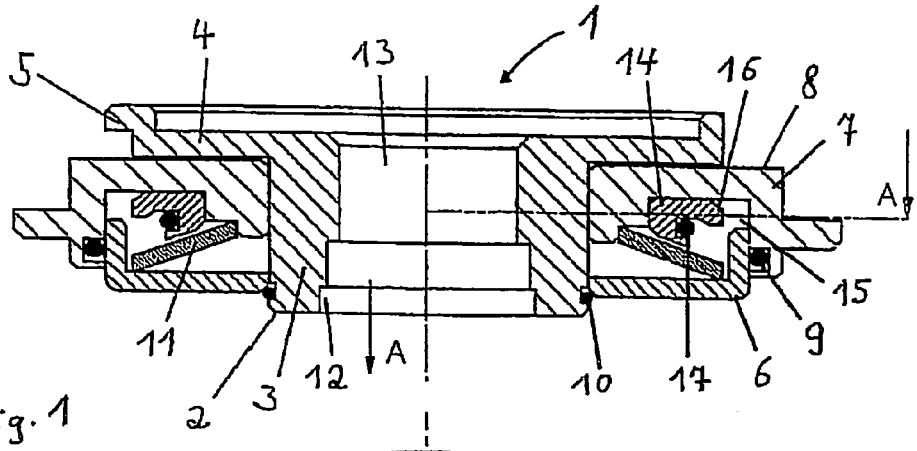

The invention concerns a fixing device with which a tool can be fixed to a machine tool, an associated tool and a clamping system formed by the fixing device and the tool.

The tool can be in particular a severing, roughing, grinding, cutting, brushing, polishing or fan grinding disk.

Known disks of that kind are screwed fast by means of a nut to a screwthreaded member of the machine tool by means of a tool, in particular a wrench. In that case the central opening in the disks is of such a size that the diameter thereof is only slightly larger than the outside diameter of the screwthreaded member of the machine tool so that the disks can be clamped on the machine tool by means of the nut. The standard diameter of the central opening is 22 mm. The forces occurring during the grinding operation cause the nut to be extremely tightened so that it can only be released by applying a large amount of force.

German laid-open application DE 100 17 458 A1 describes a grinding machine tool receiving means having an entrainment device, by way of which a tool can be operatively connected to a drive shaft. In that case the insertable tool can be operatively connected to the entrainment device by way of at least one latching element which is mounted movably against a spring element, wherein the latching element latches in an operative position of the insertable tool and positively lockingly fixes the tool in place. That provides a tool-less quick-action clamping system which however requires complicated operation, particularly when changing a tool. If the grinding machine tool receiving means is mounted for example to an angle grinding machine, then, to release the tool, a latching element unlocking button has to be pressed with one hand, while the tool has to be rotated with the other hand. It is also to be noted that, in that procedure, the drive shaft locking button of the machine is to be actuated.

U.S. Pat. No. 3,623,281 discloses a device for fixing an interchangeable grinding disk to a drive shaft of a machine. In that arrangement, projections of the fixing device, which face radially outwardly in a fastening position, engage over radially inwardly facing fastening surfaces of the tool. By virtue of the drive being switched on, a part of the fastening mechanism, by virtue of its inertia, moves in the axial direction towards the tool so that the fastening surfaces of the tool are clamped fast by the projections and the tool is axially secured and held non-rotatably. Admittedly, the described device can be operated with one hand, but the structure of the fastening mechanism is very complicated and expensive.

The object of the present invention is to facilitate fastening and releasing tools with a tool body in the form of a circular disk, in particular cutting, roughing or fan grinding disks, to and from a machine tool respectively, wherein the tool is securely held without having to entail a high level of structural expenditure.

In the device aspect, that object is attained by a fixing device and a clamping system including the fixing device and a tool which is adapted to co-operate with the fixing device and which has a tool body in the form of a circular disk, having a central opening. In that arrangement the fixing device which can be mounted on a machine tool or which is fixedly mounted to the machine tool has at least one radially outwardly facing projection of a locking means which can be actuated without the use of a tool and with which the fixing device can be releasably connected to the tool, wherein in the locking position the at least one radially outwardly facing projection of the fixing device engages over a radially inwardly facing locking surface of the tool and the tool body is axially secured and held non-rotatably. The at least one radially outwardly facing projection and a support against which the tool bears are arranged displaceably axially relative to each other, wherein said axial displacement travel can be blocked by a centrifugal force device.

The specified structural configuration of the fixing device can ensure on the one hand that a tool which is adapted to co-operate with the fixing device can be moved into an operative position using one hand in a simple manner while on the other hand the tool is securely clamped and held in operation of the machine even when external forces act thereon. In that respect the structural expenditure for the design configuration of the clamping system according to the invention can be kept at a relatively low level.

The invention is based on the idea of providing a quick-action clamping arrangement for a tool for a machine tool, which is operatively connected to a fixing device. In an operative position or locking position portions of the fixing device and the tool overlap so that the tool is axially secured. In order to move the tool and the fixing device into that locking position in a simple manner, the overlapping portions on the fixing device and a support for the tool on the fixing device are adapted to be axially displaceable relative to each other, for example against a spring force. After setting of the locking position which corresponds to an operative position, a positively locking engagement is implemented between the fixing device and the tool, which is fixed by the blocking action of a centrifugal force device. This means that, by virtue of the blocking action in respect of the axial displacement travel, the positively locking engagement between the fixing device which is driven by the machine tool and the tool is ensured, irrespective of the influence of external forces acting on the tool.

In accordance with the invention the term "radially outwardly facing projection" includes a portion or a region of the fixing device which, when the locking means is in the closed condition, that is to say in the locking position, engages over a portion or a region of the tool. Preferably, provided for the locking means are a plurality of radially outwardly facing projections disposed on the fixing device, which each engage over a respective associated radially inwardly facing locking surface of the tool so that it is possible to provide for a substantially rotationally symmetrical axial fixing effect. In that case the fixing device can be so designed that the tool can be connected thereto by simple means, for example by plugging or pushing in, clamping, pivoting and/or rotating.

Preferably the at least one radially outwardly facing projection and the support for the tool are not only axially displaceable relative to each other but are also rotatable relative to each other. In that way it is possible to prevent the tool, upon being clamped on the fixing device, grinding thereagainst and causing damage if the clamping procedure is implemented by means of a relative rotary movement of the tool and the fixing device. Accordingly, the tool can be fitted onto the support on the fixing device in an open position of the locking means, in particular it can be pressed downwardly against a spring force and rotated at the same time so that it is possible to set the locking position in which the radially outwardly facing projections of the fixing device engage over the radially inwardly facing locking surfaces of the tool without the need for the radially outwardly facing projections and the locking surfaces to be in contact during the rotary movement.

In a preferred embodiment of the invention the locking means is in the form of a bayonet locking means, by which the tool and the fixing device can be clamped fast in the locking position.

The design configuration of the centrifugal force device for blocking the axial displacement travel as between the projection and the support can be implemented in many different ways. In this respect the centrifugal force which occurs due to the rotation of the fixing device in operation of the machine tool is utilized to prevent relative axial displacement between the at least one projection and the support. In this respect, the centrifugal force can produce a positively locking engagement which directly or indirectly blocks relative displacement of the support and the radially outwardly extending projection. It is advantageous in that respect if the centrifugal force device acts in opposite relationship to a force-applying means such as a spring or an expandable O-ring which provides a return force for an element or a part thereof. In that respect the return force can serve to allow the movement of the element or the part thereof in the radial direction only when a centrifugal force occurs while when the centrifugal force is absent it causes the element or the part to be moved into an initial position again. Upon rotation of the fixing device the centrifugal force acts against the force-applying means, in which case the element is operatively connected to at least one projection which is also to be referred to as tongue and which brings about the positively locking engagement by virtue of its radial displacement or by radial expansion.

Desirably, a radially displaceable tongue can face radially outwardly and can be adapted to be expanded in the axial direction so that, upon the production of a suitably high level of centrifugal force, it closes an axial gap between mutually axially displaceable parts of the fixing device, in such a way that ultimately the axial displacement travel between the at least one projection and the support for the tool at the fixing device is blocked. In that situation, to avoid tilting of the support for the tool in regard to the at least one projection, it can be provided that the tongue is peripherally extended, for example being in the form of a multi-part ring so that blocking of the displacement travel can be effected symmetrically over substantially the entire periphery of the support. Radial insertion of an axially extended tongue into the axial gap provides that a large axial gap can already be advantageously closed with a short radial displacement of the tongue.

Desirably the element can be in the form of a semicircular pair of rings which is expandable in the radial direction, with a tongue that is extended in the axial direction, and which can be fixed by a spring to form a ring, wherein the two half-rings under the effect of centrifugal force move away from each other and radially outwardly and are pushed with the peripheral tongue into the described axial gap. It is however also possible for the annular element to include a plurality of and in particular between 3 and 6 ring segments in order to provide a particularly uniform and symmetrical blocking action for the axial displacement travel.

It is particularly advantageous if the radial displacement of the tongue causes non-parallel surfaces of relatively axially displaceable parts to come into mutual contact with each other in order to produce an axially acting force. It is possible to provide in that way that the effect of the centrifugal force device is not only to block the axial displacement travel between the at least one projection of the fixing device and the support for the tool, but also to provide that the tool is clamped between said parts under the effect of the force involved, the clamping action increasing in proportion to an increasing speed of rotation of the machine tool.

In order to provide the tool being driven by the fixing device and, particularly in the case of machine tools which can be rapidly decelerated, to prevent further rotation of the tool by virtue of the inertia mass thereof, the arrangement may desirably include an arresting device which rotatably fixes the tool with respect to the fixing device in the locking position.

The arresting device can be for example a loop member which is mounted pivotably transversely with respect to the longitudinal axis of the tool on the fixing device and which engages with at least radial projection into a corresponding groove in the tool.

Other arresting devices or configurations of radially outwardly facing projections on the fixing device may also be desirable, which are described in international patent application PCT/DE01/02268, the disclosure of which is incorporated into the present application by reference.

It is particularly desirable if the fixing device has an arresting device in the form of a nose which co-operates with the tool to provide a positively locking engagement and which can also be referred to as a dog. In that respect the at least one radially outwardly facing projection of the locking means can have an arresting nose which extends axially and in the direction towards the machine tool and which in the locking position co-operates with the associated segment on the tool, which provides the locking surface.

Such a projection on the fixing device and an associated segment on the tool can thus have two different functions. On the one hand, in the locking position the tool is secured to prevent it from axially moving away by those parts, while on the other hand they provide a positively locking engagement which after the fixing thereof serves to drive the tool. It will be appreciated that the arresting nose can also be provided on the segment of the tool, in which case that nose, to provide the positively locking engagement, engages into an associated opening in the projection of the fixing device.

A particularly advantageous configuration of the invention is represented by the arrangement of at least two peripherally spaced arresting noses of that kind for providing a pocket at the projection of the fixing device, in which the associated segment of the tool can be brought into positively locking engagement in the locking position. To permit the associated segment of the tool to be introduced into the pocket on the fixing device, the pocket is of a radially outwardly open configuration. The term "pocket" in this respect signifies a region which is delimited by the arresting noses and in which the associated segment comes to lie in the locking position. As the machine tools usually rotate in one predetermined direction, it can be provided that one of the arresting noses is adapted to transmit the drive force to the tool and the other arresting nose is adapted to transmit the forces which are produced when decelerating the machine. Advantageously in that case the arresting nose for transmission of the drive can be of a larger sectional surface than the deceleration arresting nose, in a plane parallel to the support for the tool, as the former has to transmit higher forces. It is further advantageous if one of the arresting noses is of such an axial extent that the nose serves as a rotary abutment for the tool so that it cannot be unintentionally rotated from a locking position into an open position again.

On the other hand the at least two arresting noses can also be formed on the segment of the tool, in which case the associated radially outwardly facing projection of the fixing device can be introduced into the radially inwardly open pocket to provide a positively locking engagement. This embodiment in particular enjoys the advantage that the manufacturing costs for the entrainment disk which is generally made of metal, including the at least one radially outwardly facing projection, are reduced, while providing the arresting noses on the tool will scarcely increase the production costs thereof as the arresting noses are generally formed on a carrier device for the tool, which carrier device can be produced by an injection molding process.

As explained hereinbefore a machine tool can be equipped with a fixing device, in which respect both a releasable and also a non-releasable connection is possible. If the fixing device is adapted for releasable connection to a machine tool then, by virtue of the configuration of suitable connecting means, in principle any machine tool can be fitted with the fixing device according to the invention or the clamping system according to the invention.

For example the fixing device, for clamping onto the shaft of the machine tool, may have a female screwthread with which it can be screwed onto a screwthreaded member of the machine tool. Preferably the female screwthread is arranged on a screwthreaded sleeve which is disposed in a central opening of the fixing device. The screwthreaded sleeve can be provided at one end with an annular flange which engages over the edge of the central opening at the side of the fixing device, which is remote from the screwing direction. When the fixing device is clamped on the shaft of the machine tool, the annular flange presses against the edge of the central opening so that the fixing device is securely held and the screwthreaded sleeve does not come loose from the fixing device, in particular when the fixing device is unscrewed.

For mounting to the machine tool the fixing device on the other hand may also have a central opening for passing an axially extending screw therethrough. In principle, the fixing device according to the invention can be so designed that it can be fixed to the machine tool with such means which are usually employed for fixing a tool to the machine tool, for example a clamping nut or a clamping bolt. Thus in principle all conventional machine tools can be subsequently fitted with the fixing device according to the invention without additional conversion measures being required.

The object of the invention is further attained by a clamping system including the described fixing device according to the invention and a tool adapted to co-operate with the fixing device and having a tool body in the form of a circular disk, having a central opening. As described, the tool and the fixing device are so matched to each other that, in a locking position, that is to say in an operative position, a positively locking engagement is afforded between the two and that positively locking engagement is fixed upon rotation of the fixing device, that is to say operation on a machine tool, by means of a centrifugal force device. In that way that positively locking engagement can be used for transmission of the drive force to the tool so that the fixing device and the tool co-operate for axially securing and non-rotatably holding the tool.

The locking surfaces on the tool can advantageously be afforded by the tool body itself which has the grinding means. By virtue of that arrangement, particularly when dealing with relatively thick tool bodies, the carrier device which is used in relation to conventional grinding disks for the tool body can be omitted, which affords advantages in ecological and economic terms.

On the other hand the tool, particularly when thinner tool bodies are involved, to increase the stability thereof may have a carrier device on which are provided the radially inwardly facing locking surfaces of the tool. In that arrangement the carrier device is provided in the opening of the tool body and is fixed thereto. That fixing can be in particular a non-releasable fixing which, in the production procedure, can be particularly easily afforded by adhesive means. The term "non-releasable" is to be interpreted as meaning that the carrier device and the tool body can be separated from each other only by causing damage thereto or destruction thereof. That can ensure that the tool body and the carrier device are permanently connected together.

The stability of the tool body can be considerably enhanced by the tool body being gripped in the region of its central opening by the carrier device. In that case the carrier device can be so designed that it engages over the edge of the opening at least at one side of the tool body, wherein the fixing device in the clamping system engages over the edge of the central opening at the other side of the tool body so that the tool body is gripped by both devices and, by virtue of fixing thereof to each other, it is axially secured and held non-rotatably. A one-sided carrier device of that kind can be for example in the form of a ring which is L-shaped in longitudinal section so that the tool body can be axially fitted thereonto and held at one side by the radially outwardly extending annular flange. The fixing device can be fixed to that holding device in such a way that it presses against the other side of the tool body, with a radial flange which also engages over the edge of the opening, in which case it is axially secured and held non-rotatably so that ultimately a reduced amount of material is necessary to provide the carrier device.

On the other hand however the carrier device can also be so designed that it engages over the edge of the central opening of the tool body at the two sides thereof to provide for axial securing and non-rotatable holding thereof. In this embodiment, the central opening of the tool body is gripped exclusively by the carrier device, for example in a U-shaped configuration, so that no parts of the fixing device come into contact with the tool body and can be damaged thereby. This carrier device can also be injection molded directly on the tool body.

Advantageously the carrier device can also be so constructed that tool bodies involving different radii and possibly different thicknesses can be gripped therewith so that the clamping system according to the invention can be used for a large number of different tool bodies as solely the carrier device has to be adapted to co-operate with the fixing device, with the respective carrier device additionally being matched to the respective tool body.

In general terms the carrier device can be made for example from plastic material, wood, metal, ceramic or any other suitable material, in which respect the tool body can be axially secured and held non-rotatably in the carrier device also by screwing or pressing, whereby, for each tool body, it is possible for a carrier device which is optimally adapted, in regard to the material properties and purpose of use of the tool body, to be fixed thereto.

Regarding the configuration of positively locking connection between the parts of the clamping system, that is to say the fixing device and the tool in the locking position, it is advantageous if at least one and desirably two arresting noses extend axially and in a direction away from the machine tool, from a radially inwardly facing locking surface of a segment of the tool, wherein the arresting noses are peripherally spaced to provide a pocket on the locking surface. The associated projection of the fixing device can be introduced in that pocket into a condition of positively locking engagement with the segment of the locking surface.

If there is only one individual arresting nose provided at the locking surface, it engages into an associated opening at the projection of the fixing device to provide the positively locking engagement. The provision of the arresting noses on the tool, in particular on the carrier device for the tool body, affords the advantage that the wear, which is produced in the grinding operation due to the transmission of force, of the arresting noses which act as drive dogs or as braking dogs, can remain substantially unheeded as the tool is naturally regularly exchanged and thus has a substantially shorter service life than the fixing device. As the carrier device can be made from plastic material, the relatively complicated operation of shaping the arresting noses can be implemented easily and inexpensively as they can be produced by injection molding. A further substantial advantage of providing the arresting noses on the tool, in particular on a carrier device made of plastic material for the tool body for the clamping system of the invention is manifested in situations in which a complete positively locking engagement has not yet been made between the tool and the fixing device and the machine tool is switched on. By virtue of the high level of acceleration of the fixing device and due to the inertia of the tool, it is automatically moved into the working position after the machine is set in operation and is then locked by the centrifugal force device. In that respect, that procedure is supported by virtue of the fact that the arresting noses on the carrier device move easily over the projections of the fixing device, which are generally made from metal, while in situations where relatively sharp-edged metal noses or dogs are moved over a projecting plastic portion, there is the danger that the metal noses dig into the plastic material. In contrast thereto the plastic dogs slide easily movably over the metal surfaces so that the tool is moved automatically into the locking position, that is to say the working position, and is subsequently fixed by the centrifugal force device.

As is already the case in relation to the above-described provision of the arresting noses on the fixing device, the arresting nose serving as a drive dog, when it is formed on the carrier device for affording a rotary abutment for the tool, may also be of a greater axial extent than the other arresting nose which serves for deceleration purposes. That ensures that, both when manually producing the locking position and also when starting up the machine tool, the tool cannot be over-rotated out of the locking position.

If the locking means includes a plurality of projections on the fixing device and a plurality of locking surfaces or segments on the tool, then desirably all segments may each have two arresting noses so that a plurality of arresting noses and preferably three serve simultaneously as drive and braking dogs respectively, whereby the loading at a single nose can be reduced. Admittedly, due to the production procedure involved, by virtue of the manufacturing tolerances at the beginning of operation under some circumstances only one individual dog will transmit the drive force, but by virtue of the loading involved, after a "running-in time", that dog will be deformed to such an extent until all dogs bear against at least partially axially extending surfaces of the respective projection of the fixing device and thus all dogs take up the drive for the tool.

The two co-operating parts of the clamping system according to the invention, the fixing device and the tool, are matched to each other in such a way as to ensure the function of the fixing device, that is to say, a tool in a clamped position is held ready for operation axially and non-rotatably. Desirably, the fixing device and the tool can be so matched to each other that, after the described positively locking engagement has been formed between the at least one projection of the fixing device and the associated segment on the tool, the centrifugal force device is automatically axially oriented for blocking an axial displacement travel between the projection and the tool support. The axial orientation effect ensures that the centrifugal force device blocks the axial displacement travel between the projection and the tool support when the machine is switched on, for example by means of a radially outwardly moving tongue or the like which moves into an axial gap. That blocking action can be effected in particular by a positively locking engagement, in the axial direction.

In order to ensure that the production tolerances which occur in manufacture of the tool and the fixing device respectively do not mean that the tool is not fixedly clamped in position even upon fixing of the positively locking engagement by the centrifugal force device, it can be provided that the centrifugal force device affords a means which converts the centrifugal force which occurs, by way of inclined surfaces, into an axial force which provides for clamping of the tool in the fixing device.

In the method aspect the object of the invention is attained by a method of tool-free clamping a tool to a tool body in the form of a circular disk and having a central opening on a fixing device for a machine tool. The procedure involved in bringing the fixing device and the tool which is of an associated configuration together can advantageously be carried out by means of one hand. In this situation the disk-shaped tool is gripped at its periphery, after blocking of the drive shaft introduced in the open position of the locking means into the fixing device, moved by rotation of the tool into an overlapping position in respect of the projections and locking surfaces, and then brought into a condition of positively locking engagement with the fixing device. The positively locking engagement is automatically blocked when the machine is switched on. Thus, only the tool has to be moved for the clamping operation so that the second hand can remain free for example for holding the angle grinder and for actuating the drive shaft locking button.

Figure 2:
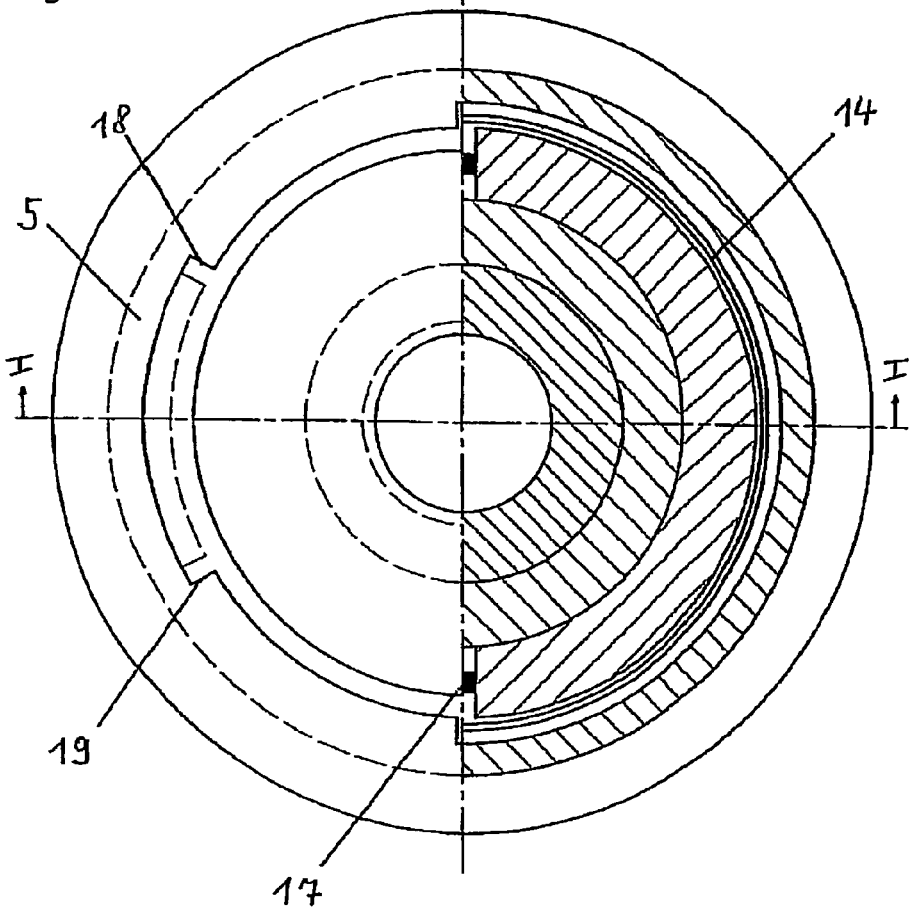
Figure 3:
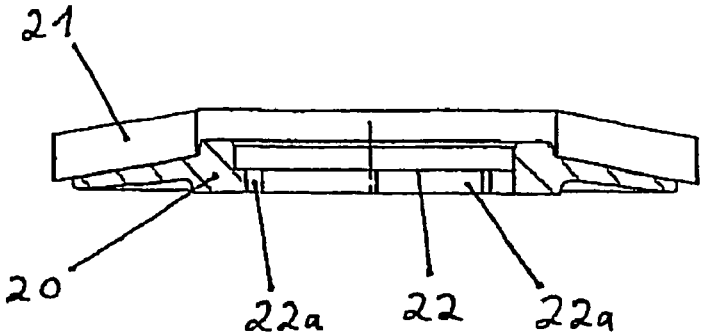
Figure 3:
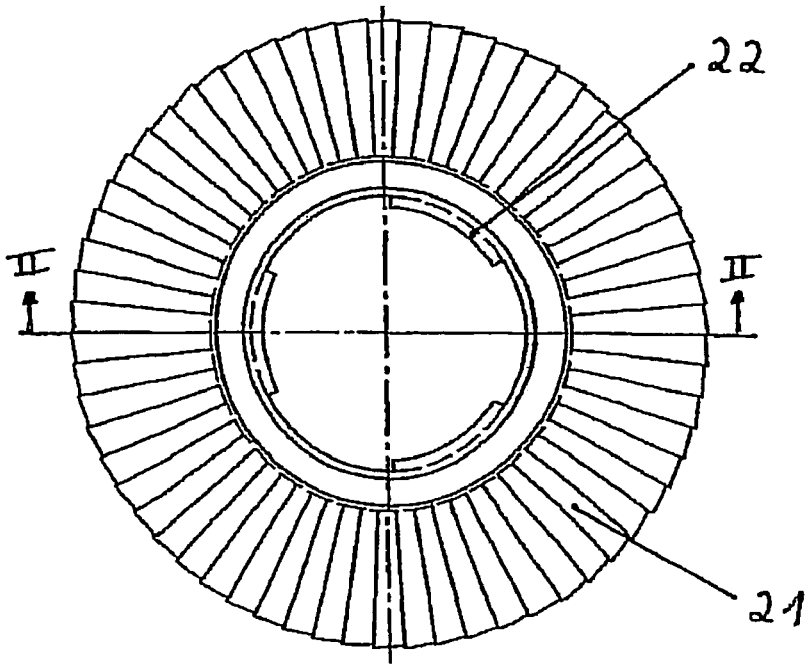
Figure 4:
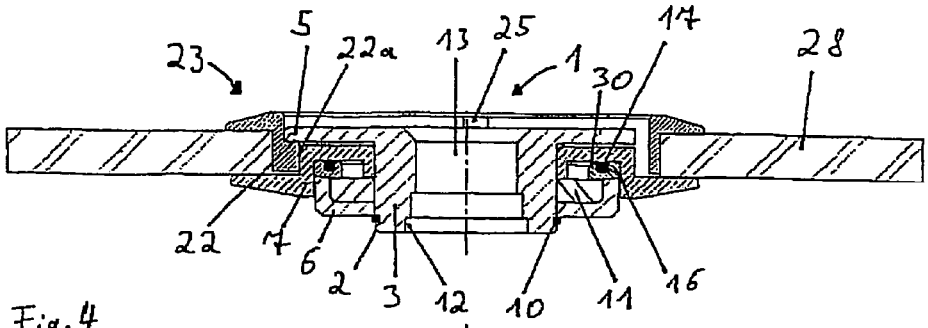
Figure 5:
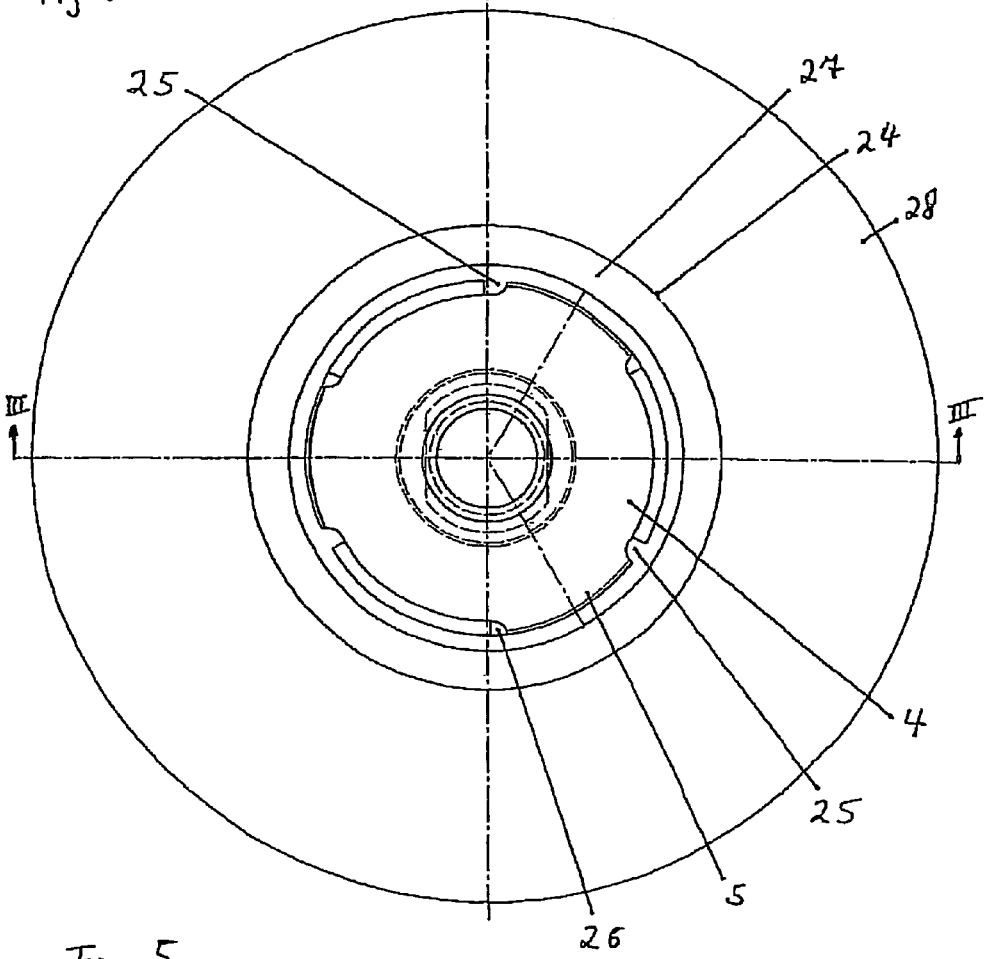
Figure 6:
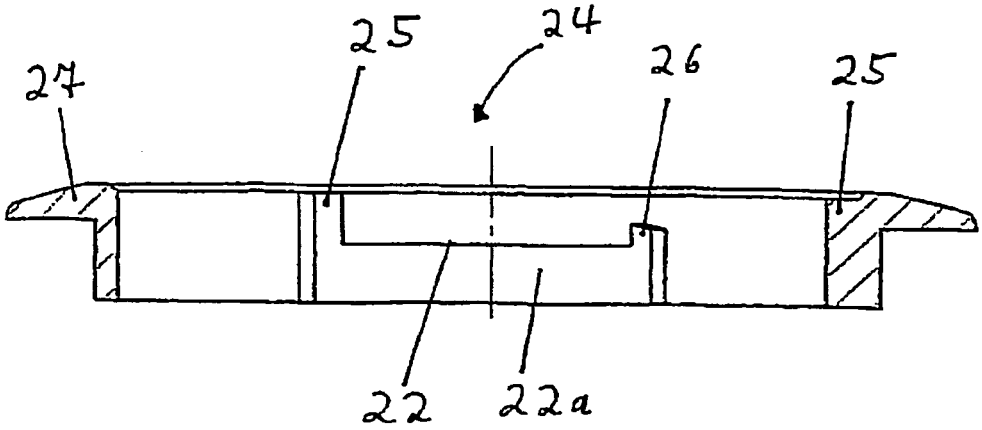
Figure 6:
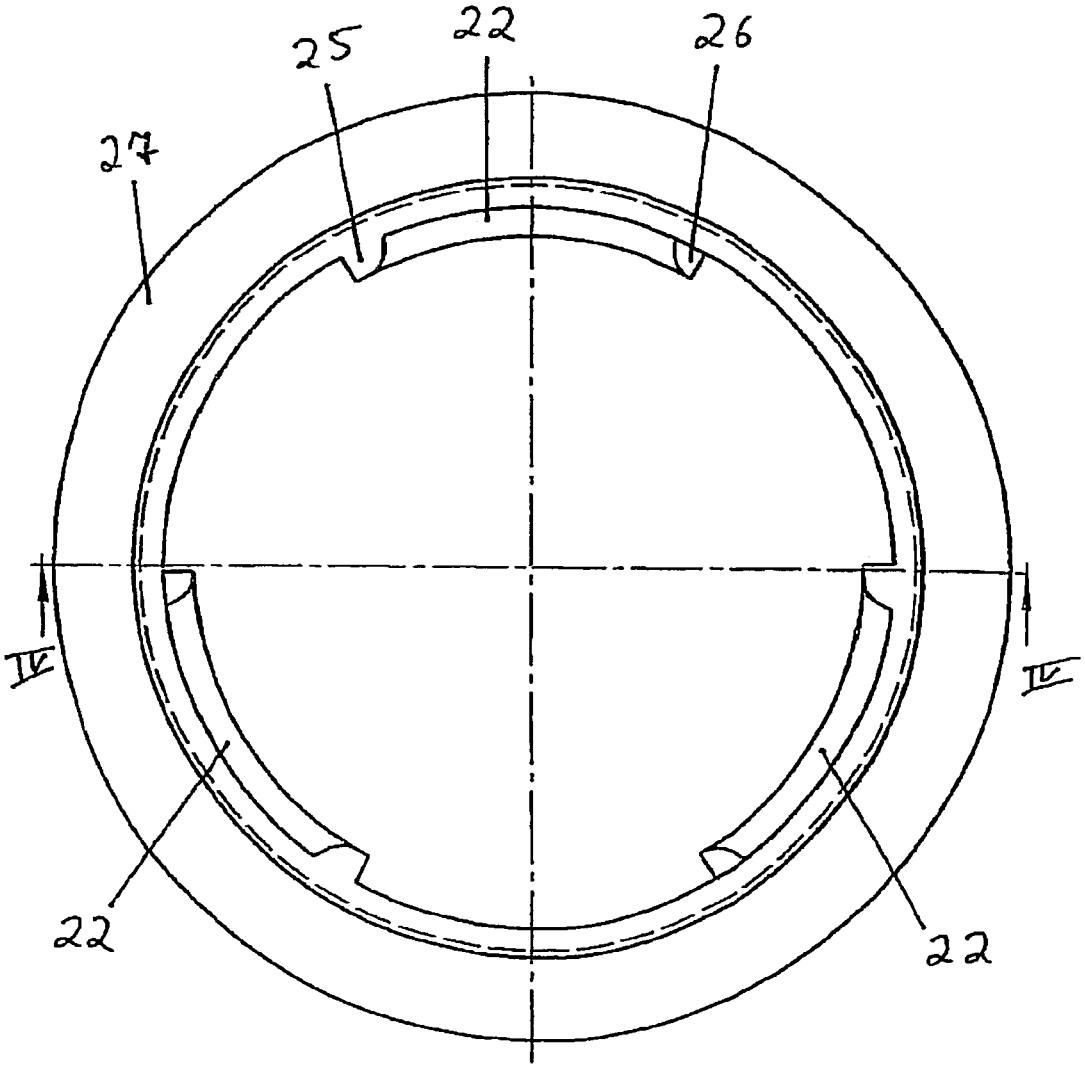
Figure 7:
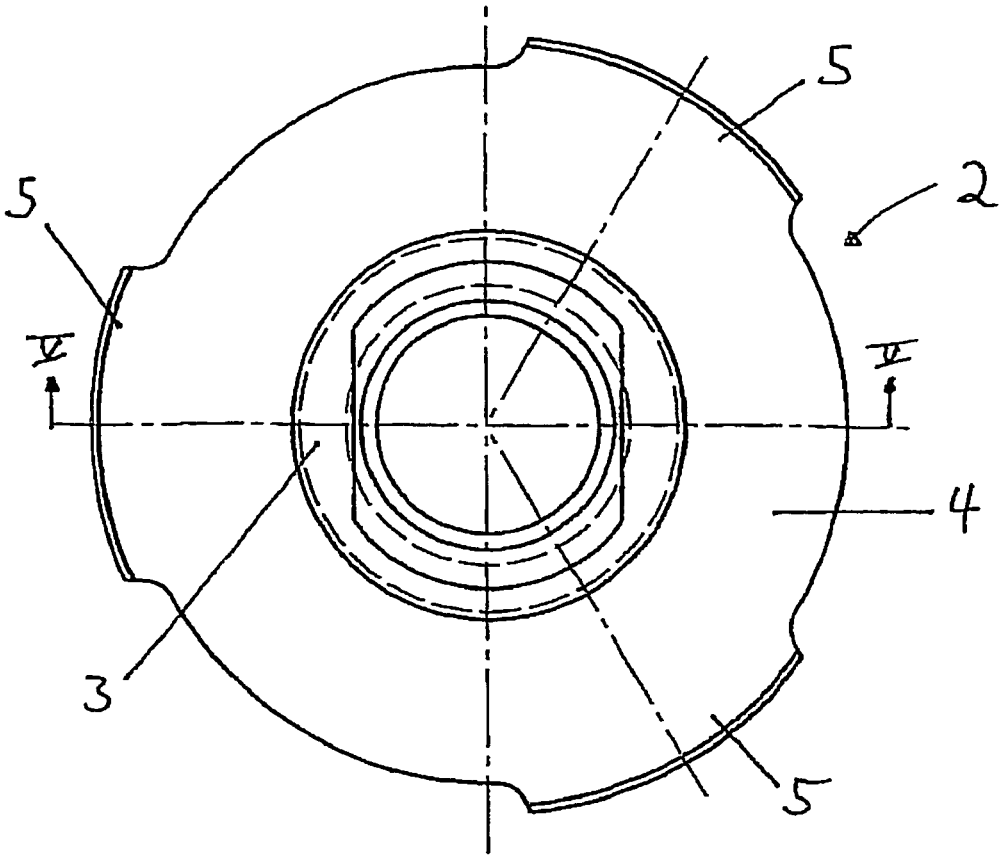
Figure 7:
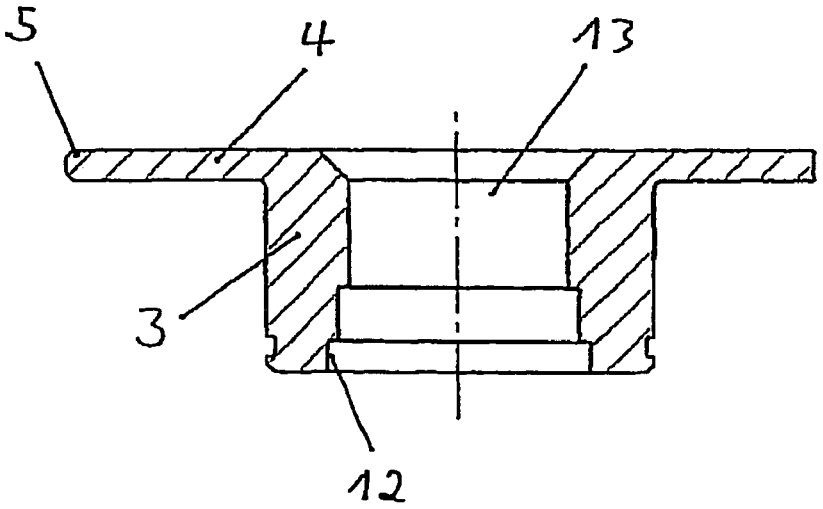
Figure 8:
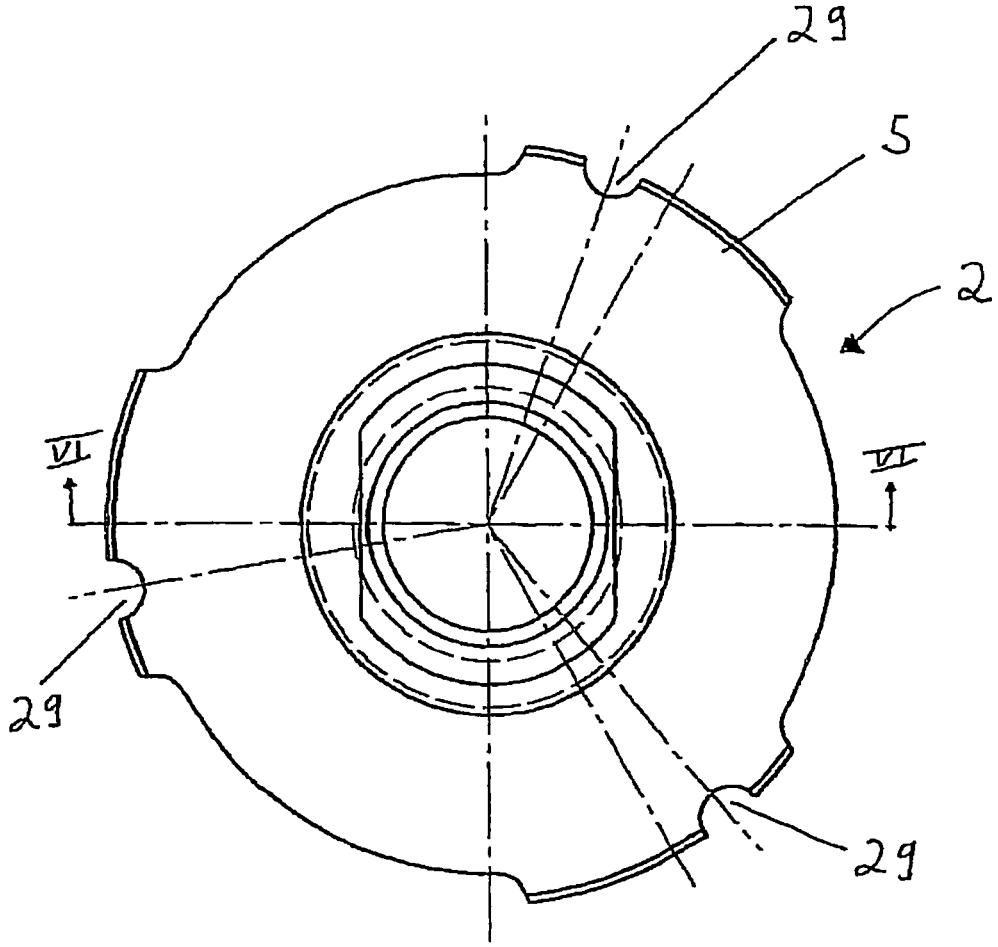
Figure 8:
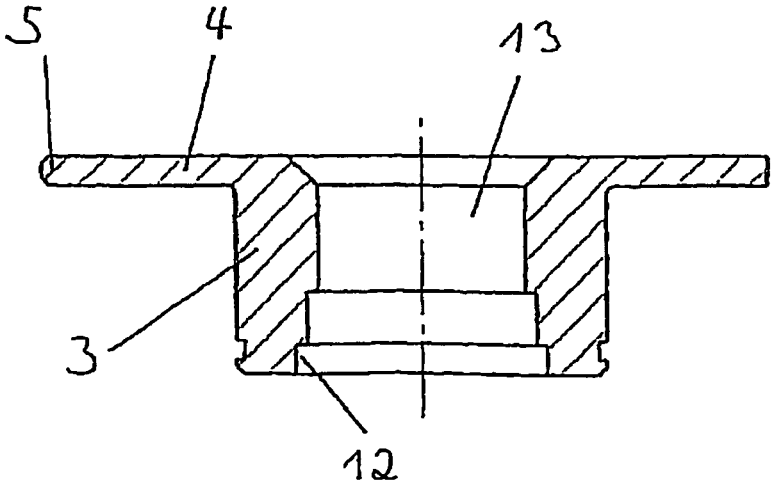
Figure 9:
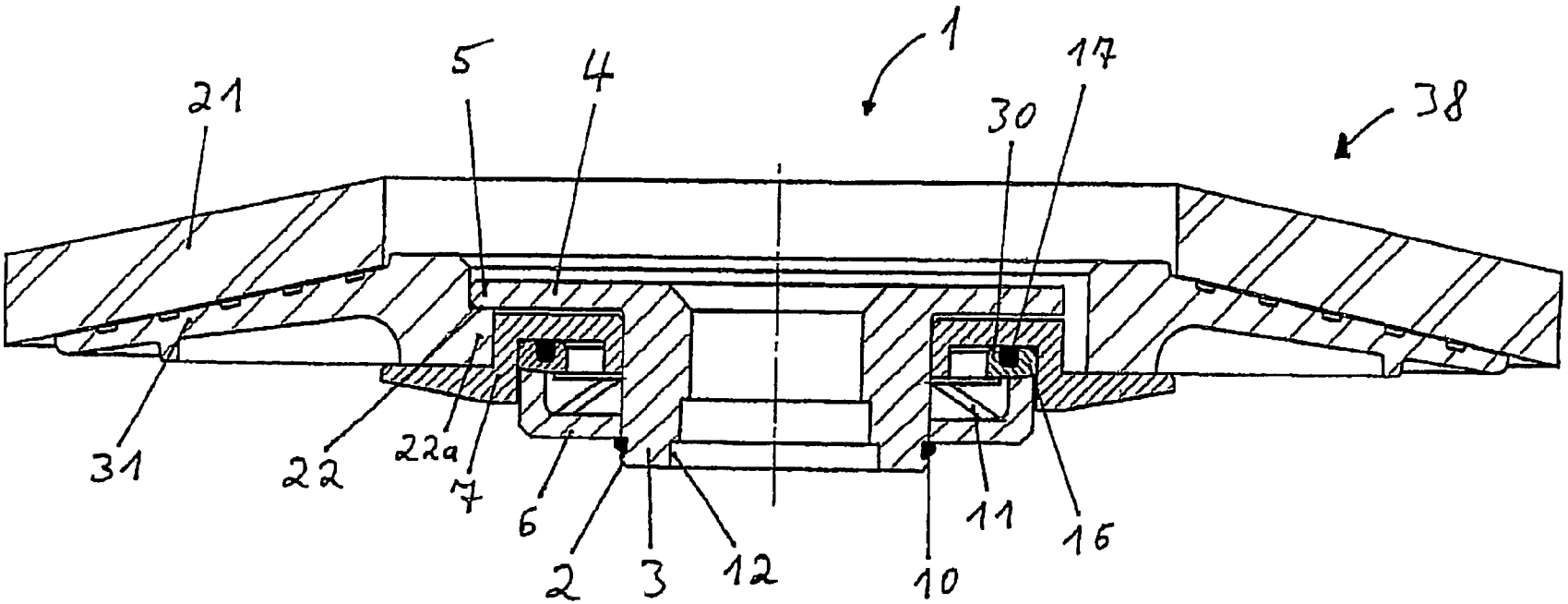
Figure 10:
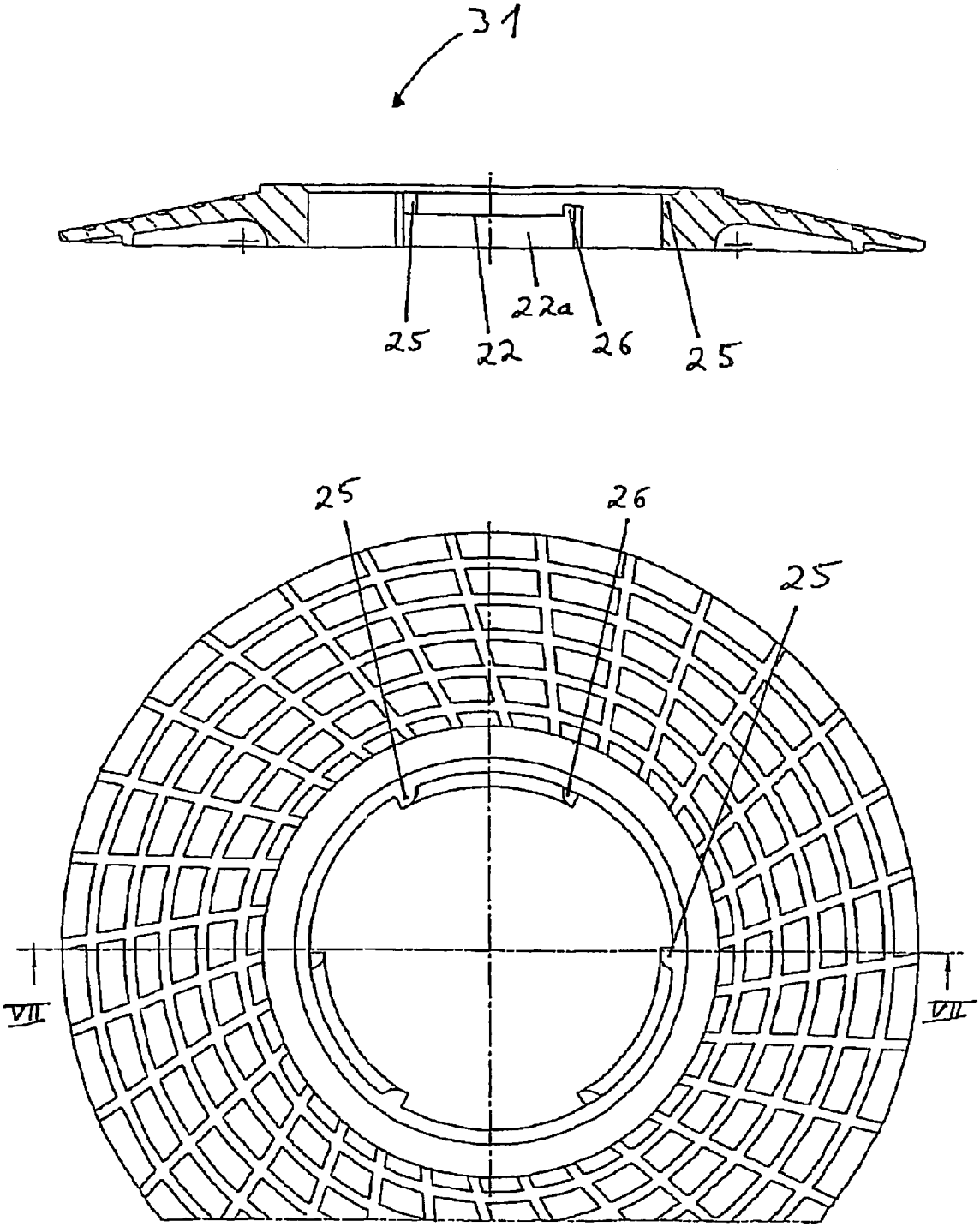
Figure 11:
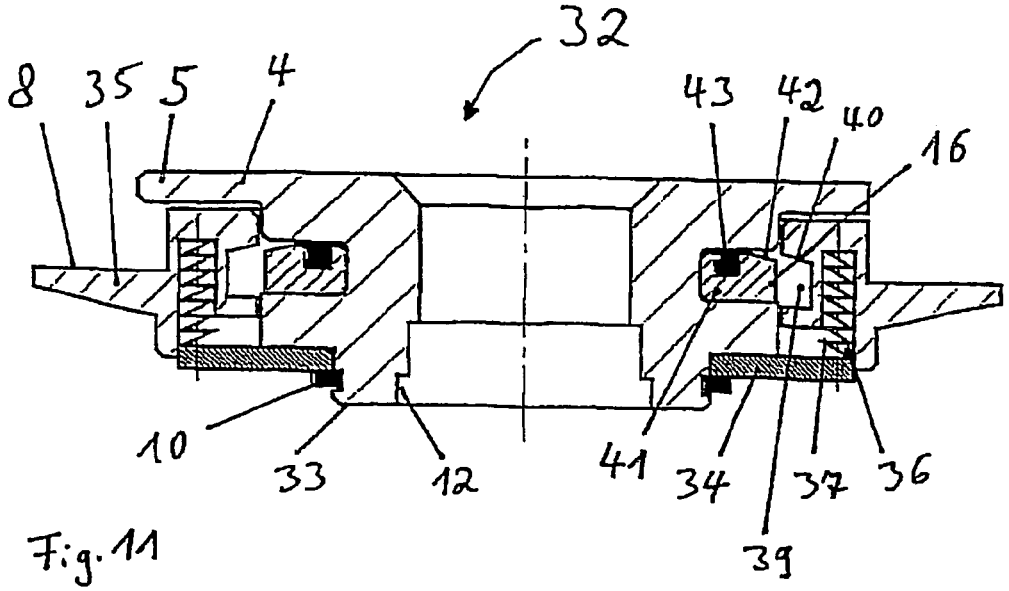
Figure 12:
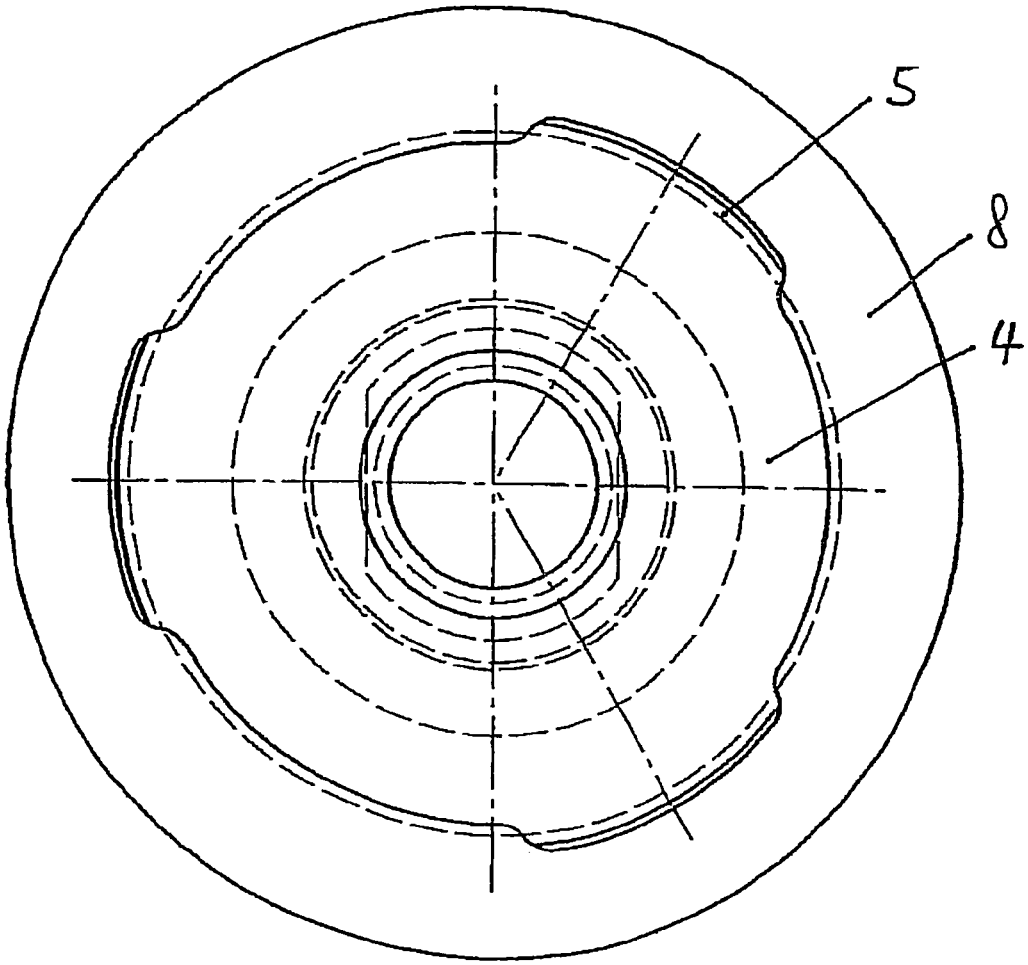

Preferred embodiments of the invention are described in greater detail hereinafter with reference to the drawings in which:

FIG. 1 is a sectional view of a first embodiment of a fixing device according to the invention, FIG. 2 is a plan view of the fixing device shown in FIG. 1, FIG. 3 is a sectional view and a plan view of a fan grinding disk which can be connected to the fixing device shown in FIG. 1, FIG. 4 shows a clamping system according to the invention with a further embodiment of a fixing device, FIG. 5 shows a plan view of the clamping system of FIG. 4, FIG. 6 is a view in section and a plan view of an embodiment of a carrier device for the configuration of the tool of FIG. 4, FIG. 7 is a view in section and a plan view of the entrainment element of the fixing device of FIG. 4, FIG. 8 is a view in section and a plan view of another entrainment element for a further embodiment of a fixing device, FIG. 9 shows a further clamping system according to the invention with a fan disk, FIG. 10 is a view in section and a plan view of a carrier device for the fan disk of FIG. 9, FIG. 11 is a view in section of a further embodiment of a fixing device according to the invention, and FIG. 12 is a plan view of the fixing device of FIG. 11.

Referring to FIGS. 1 and 2, shown therein is a first embodiment of a fixing device according to the invention for co-operation with a tool having a tool body in the shape of a circular disk, with a central opening, wherein FIG. 1 is a view in section taken along line I in the plan view of FIG. 2.

The fixing device 1 has a support device 7 onto which a grinding disk can be fitted. In order to accommodate grinding disks of differing thicknesses, for example roughing-out and cutting grinding disks, the support surface 8 is of a stepped configuration with two annular flanges. The fixing device has three radially outwardly facing, peripherally spaced projections 5 of which however only one is visible in the Figure. The projections 5 on the fixing device 1 are arranged movably in the axial direction with respect to the support 7. The latter is arranged movably axially and rotatably axially relative to the axially outwardly facing projections 5. Axial mobility is achieved by the arrangement of a diaphragm spring 11 between a bottom element or housing portion 6 and the support device 7 so that, when the fixing device is mounted on the machine tool, the latter is movable in a direction towards the machine tool. An O-ring 9 prevents dust or moisture from penetrating into the fixing device 1. A circlip 10 serves as an end abutment for the bottom element 6. The fixing device 1 has a central opening 13, by means of which mounting on the machine tool can be implemented. In this case, the fixing device is secured to the machine tool by means of a clamping nut (not shown) or a screwthreaded bolt. For example the recess 12 at the side of the fixing device, which is towards the machine, can serve as a complementary recess for an entrainment means on the drive shaft of the machine tool, wherein the shaft extends beyond the opposite end face of the fixing device with a screwthreaded portion onto which a nut can be screwed so that the fixing device 1 according to the invention is fixedly connected to the machine and is driven thereby.

In the procedure for changing a grinding disk, by way of the grinding disk the support 7 is pressed downwardly against the diaphragm spring 11, by applying a slight axial pressure. Due to a subsequent rotary movement, the projections or surfaces of the grinding disk are rotated through, below the axially extending arresting nose 19. In that situation the support 7 also rotates so that it does not experience any abrasion wear due to the grinding means if a tool which does not have a carrier device at the face towards the machine tool is fitted into the fixing device. As soon as the inwardly facing projections or surfaces of the grinding disk and the projections 5 of the fixing device are disposed in mutually superposed relationship, the axial pressure against the diaphragm spring 11 is removed, whereby the support 7 is urged into the initial position by the force of the diaphragm spring 11 and the locking surfaces or projections of the grinding disk latch between axially extending arresting noses 18 and 19. The arresting nose 18 serves essentially as an abutment for carrying the grinding force, that is to say as a drive dog, while the arresting nose 19 carries the inertia forces which are caused by the grinding disk in the machine tool deceleration phase, that is to say the arresting nose 19 serves as a braking dog. A positively locking connection is formed in the rotational direction between the parts by virtue of the above-described latching engagement of the projections on the grinding disk between the axially extending arresting noses 18 and 19.

Bearing against the side of the support 7, which is towards the housing portion 6, is a semicircular pair of rings 14, which is urged radially inwardly by means of an annular spring 17 which encloses both half-rings. After the machine tool is switched on with the fixing device in the mounted condition, the semicircular pair of rings 14 is urged outwardly by centrifugal force against the force of the annular spring 17. As a result, an annular projection 16 is displaced into an axial gap 15 between the support 7 and the bottom element 6. Thus, the axial displacement travel between the projections 5 and the support 7 is blocked, as the support can no longer move in the direction of the machine tool, whereby unintentional release of the grinding disk is prevented. It is only after the machine comes to a halt that the annular spring 17 pulls the two ring halves 14 back into their initial position, whereby the axial gap 15 is again cleared.

As illustrated, the fixing device according to the invention essentially comprises only five parts, so that the structural complication and expenditure remains limited. The entrainment element 2 which is driven by the machine has a sleeve 3, on which an entrainment disk 4 is formed at the end remote from the machine. The entrainment disk 4 has the radially outwardly facing projections 5. The support device 7 against which the tool comes to bear directly upon being clamped in position is arranged axially displaceably relative to the entrainment element which is rigid in the axial direction. The bottom element 6 which is mounted rigidly relative to the entrainment element 2 serves as a base for the diaphragm spring 11 by which it is supported for applying a spring force against the axially displaceable support device 7. The last essential part of the fixing device 1 is the centrifugal force device including the pair of rings 14 and the annular spring 17 which serves for fixing the above-described positively locking connection between the tool and the fixing device. Upon displacement of the support device associated surfaces of the entrainment element and the support and of the support and the bottom element slide against each other, whereby the internal space formed by the support, the entrainment element and the bottom element, for accommodating the centrifugal force device, remains closed.

FIG. 3 shows a plan view and a view in section taken along line II of a tool in the form of a fan grinding disk, which co-operates with the fixing device shown in FIGS. 1 and 2. The fan grinding disk has a carrier device 20 which is provided on an outer annular flange with a tool body 21 which is formed by grinding segments arranged in scale-like mutually superposed relationship. The carrier device 20 of the tool further includes three locking surfaces 22 which co-operate with the projections 5 of the fixing device in the locking position. As described, segments 22*a* which provide the locking surfaces 22 at the end remote from the machine respectively latch between associated arresting noses 18, 19 to provide a positively locking engagement.

A further embodiment of a clamping system according to the invention, including a fixing device 1 and a tool 23 co-operating with the fixing device, is shown in FIGS. 4 and 5, FIG. 4 being a view in section along line III of the plan view shown in FIG. 5. The tool 23 which is clamped in the fixing device 1 is in the form of a roughing disk with a tool body 28 which is gripped by a one-sided carrier device 24. The carrier device is in the form of a ring which is of L-shaped longitudinal section, wherein the tool body 28 is fitted axially onto the carrier device and glued thereto. In that condition the radially extending annular flange 27 embraces the edge of the opening of the tool body 28 on the side of the fixing device, which is remote from the machine. The tool body 28 bears directly against the support device 7 on the opposite side.

The fixing device 1 is of a structure substantially like the fixing device illustrated in FIG. 1, with elements having the same action being denoted by the same references. The centrifugal force device including a plurality of and in particular three or four ring segments 30 and the annular spring 17 is shown in FIG. 4 in the blocking position, that is to say with the fixing device being driven. This signifies that the support device 7 cannot be moved down in the direction of the machine tool against the force of the diaphragm spring 11 as the projection 16 blocks the axial gap between the bottom element 6 and the support device 7. In that arrangement the three or four annular segments are arranged on a periphery so that the axial gap is of a substantially rotationally symmetrically closed configuration.

The essential difference in relation to the first clamping system according to the invention, the parts of which are shown in FIGS. 1 and 3, is that the arresting noses or dogs do not extend on the projections 5 of the axially fixed entrainment disk 4 axially in the direction towards the machine tool, but are mounted to the carrier device of the tool and extend axially in the opposite direction, see FIG. 5, in which the braking dogs on the carrier device 24 are denoted by reference 26 and the drive dogs on the carrier device are denoted by reference 25. In the illustrated locking position between the fixing device and the tool, the three projections 5 of the entrainment disk 4 of the entrainment element 2 engage over the respectively associated locking surfaces 22 which are provided at the carrier device by segments 22*a*. In the present case also, in the locking condition, a positively locking engagement is afforded between the fixing device and the tool in the locking position as the projections 5 are respectively latched between the associated arresting noses 25, 26 and bear against the respective locking surfaces.

The structure of the carrier device 24 used in the clamping system according to the invention in FIGS. 4 and 5 is shown in FIG. 6 as a plan view and a view in section taken along line IV. The annular carrier device 24 has an annular flange 27 which engages over an edge of the tool body at the side remote from the machine, see FIG. 4. Each of the three locking surfaces 22 which are formed by respective segments 22*a* is delimited by a drive dog 25 and an associated braking dog 26. As can be seen from the sectional view the drive dog 25 is longer in respect of its axial extent, in such a way that, even when the support device 7 is moved axially in the direction of the machine tool, the associated projection 5 on the entrainment disk 4 cannot be rotated beyond the drive dog.

In further embodiments the clamping system according to the invention has two or more than three projections at the fixing device and the respective associated locking surfaces on the tool.

A detail drawing of the entrainment element 2 of the clamping system illustrated in FIGS. 4 and 5 is shown in FIG. 7 as a plan view and a view in section taken along line V. The entrainment element 2 includes a sleeve 3 with a recess 12 for the entrainment member on the machine and at the opposite end an entrainment disk 4 which has three projections 5 which chamfered at their radial ends. The forces are transmitted or carried by the projections at the axially extending side edges thereof, against which the respective arresting noses bear. A further advantageous configuration of the entrainment element 2 is shown in FIG. 8. Unlike the entrainment element illustrated in FIG. 7 the projections 5 each have a radial recess 29 into which engages a dog of a corresponding configuration on a locking surface (not shown) of the carrier device. By virtue of that arrangement, the total surface area for transmission of the drive force or the inertia force can be increased.

The clamping system according to the invention can be used in principle for all tools with a tool body in the form of a circular disk. In that respect, the fixing device and the tool are so matched to each other in respect of the geometrical dimensions that, after the described positively locking engagement has been afforded, on the one hand the centrifugal force device is axially oriented for blocking the axial displacement travel between the radial projections 5 with respect to the support device 7 and on the other hand when the centrifugal force device is working the clamped tool has no or only a very small amount of play.

FIG. 9 shows a further clamping system according to the invention, which includes the fixing device illustrated in FIG. 4 and a fan disk of an associated configuration, with a carrier device 31 and a tool body 21 which is formed by grinding segments which are in scale-like mutually superposed relationship. As the fixing device shown in FIG. 9 is identical to that of FIG. 4, there is no need to describe it in greater detail here. A similar consideration applies for the carrier device 31, illustrated in FIG. 10, of the clamping system shown in FIG. 9, which is fitted with grinding segments to embody a tool.

A further fixing device according to the invention is shown in FIGS. 11 and 12. The fixing device 32 again comprises an entrainment element 33 driven by the machine tool by way of the recess 12. Arranged at the end remote from the machine is the entrainment disk 4 having the peripherally spaced projections 5. Provided approximately at the center of the axial extent of the entrainment element is a peripheral, radially outwardly facing groove which accommodates four ring segments 41 which are held in the groove by an O-ring 43 of an elastic material. The ring segments 41 are displaceable radially outwardly in the groove, in which case the O-ring 43 serves as a means for providing a return force. A plurality of and in particular four coil springs 37 which extend axially in the support device in blind bores 36 bear against a disk-shaped bottom element 34 which is fixedly connected to the entrainment element 33 by way of a circlip 10. Accordingly, the support device 35 can be moved in the direction of the machine tool, whereby once again this provides axial displacement travel as between the projections 5 and the support surface 8.

The support device has an axially expanded and radially inwardly open groove 39 associated with the centrifugal force device. When a tool of a suitable configuration, like for example that shown in FIG. 9 or 4, is brought into positively locking engagement with the fixing device 32, the ring segments 41 are again oriented automatically with respect to an axial gap, that is to say in the present case with respect to the groove 39 in the form of an axial gap in the support, so that, under the influence of the centrifugal force, when the machine is switched on, the segments 41 can pass into the groove to block the axial displacement travel.

At its surface remote from the tool, each ring segment has a contact surface 42 co-operating with an associated contact surface 40 of the groove 39 in the support device 35. The two surfaces are at an angle relative to each other so that, when the ring segments 41 move radially outwardly, by virtue of a taper effect on the part of the two contact surfaces 40, 42, an axially directed force is produced which urges the support device 35 in the direction towards the clamped tool, whereby the tool is clamped between the support surface 8 and the radially outwardly facing projections 5. It is possible in that way to compensate for production tolerances in manufacture of the various parts of the clamping system according to the invention.

When the clamping system is assembled the tool (23, 38) and the fixing device (1, 32) are brought together in an open position of the locking means between the fixing device and the tool, by applying a force directed axially in opposite relationship to a spring, in the direction of the machine tool. In that case the open position of the locking means corresponds to a relative arrangement of the fixing device and the tool, in which the segments (22*a*) on the tool, which provide the locking surfaces (22), are disposed in the peripheral gaps between the projections (5) of the fixing device, so that the tool can be moved further past the projections in the direction of the machine tool. The locking position is produced by virtue of the fact that, by rotation of the tool, the radially outwardly facing projections (5) on the fixing device are rotated relative to each other in relation to the radially inwardly facing locking surfaces (22) of the tool so that projections of the fixing device engage over radially inwardly facing locking surfaces of the tool. In that situation, the removal of the axial force affords a positively locking engagement between the fixing device and the tool, which is secured automatically by the operation of the machine tool, by means of a centrifugal force device, by virtue of blocking of the axial displacement travel between the support for the tool and the projections on the fixing device.

LIST OF REFERENCES

1 fixing device
2 entrainment element
3 sleeve
4 entrainment disk
5 projection
6 bottom element, housing portion
7 support device, support
8 support surface, annular flange
9 O-ring
10 circlip
11 diaphragm spring
12 recess
13 opening
14 pair of rings
15 axial gap
16 projection, tongue
17 annular spring
18 arresting nose, drive dog on the entrainment disk
19 arresting nose, braking dog on the entrainment disk
20 carrier device for grinding segments
21 tool body
22 surface, locking surface on the tool
22*a* segment on the tool
23 tool
24 carrier device
25 arresting nose, drive dog on the carrier device
26 arresting nose, braking dog on the carrier device
27 annular flange
28 tool body
29 radial recess
30 ring segment
31 carrier device for fan grinding disk
32 fixing device
33 entrainment element
34 bottom element
35 support device, support
36 blind bore
37 coil spring
38 tool
39 groove
40 contact surface
41 ring segment
42 contact surface
43 O-ring

The invention claimed is:

1. A tool co-operating with a fixing device, said tool comprising:

a fixing device body in the form of a circular disk, with a central opening, and a radially inwardly facing locking surface, said tool which can be mounted on a machine tool or with which a machine tool is directly equipped;

said fixing device comprising at least one radially outwardly facing projection of a locking mechanism, which can be actuated manually and with which said fixing device can be releasably connected to said tool, wherein in the locking position the at least one radially outwardly facing projection of the fixing device engages over said radially inwardly facing locking surface of said tool, said tool body axially secured and held non-rotatably relative to the fixing device, wherein the at least one radially outwardly facing projection of the fixing device and a support on said fixing device are arranged axially displaceable relative to each other, wherein the axial displacement travel is blockable by a centrifugal force device, wherein the locking mechanism is in the form of a bayonet locking mechanism by which the tool and the fixing device can be clamped fast in the locking position.

2. A tool co-operating with a fixing device as set forth in claim 1 characterized in that the at least one radially outwardly facing projection and the support for the tool are arranged axially rotatably relative to each other.

3. A tool co-operating with a fixing device as set forth in claim 1 characterized in that there is provided an additional arresting device by which the tool can be secured non-rotatably with respect to the fixing device in the locking position.

4. A tool co-operating with a fixing device as set forth in claim 1 characterized by at least one arresting nose which extends axially and in the direction of the machine tool on a radially outwardly facing projection of the locking mechanism and which co-operates with an associated segment on the tool, providing the locking surface for affording a positively locking engagement between the projection and the segment in the locking position.

5. A tool co-operating with a fixing device as set forth in claim 4 characterized by two peripherally spaced such arresting noses for providing a pocket on the at least one radially outwardly facing projection of the fixing device, in which pocket the associated segment of the tool can be brought into a condition of positively locking engagement in the locking position.

6. A tool co-operating with a fixing device as set forth in claim 4 characterized by two peripherally spaced such arresting noses in that one of the arresting noses is adapted to transmit the drive force and the other arresting nose is adapted to transmit the inertia forces produced upon braking of the tool, wherein to provide a rotary abutment for the tool the former is of greater axial extent than the other arresting nose.

7. A tool co-operating with a fixing device as set forth in claim 1 characterized in that the at least one radially outwardly facing projection of the locking mechanism, in the locking position, is adapted to provide positively locking engagement with a segment of the tool, which affords an associated locking surface, wherein formed on the segment of the tool is a radially inwardly open pocket into which the projection can be introduced to provide the positively locking engagement.

8. A tool co-operating with a fixing device as set forth in claim 7 characterized in that at least one respective axial surface on the at least one radially outwardly facing projection in the locking position transmits the drive force and the inertia forces produced upon braking of the tool.

9. A tool co-operating with a fixing device as set forth in claim 1 characterized in that the centrifugal force device comprises at least one radially displaceable tongue introducible into the axial displacement travel wherein the tongue and the support are axially displaceable relative to each other and wherein the radial displacement of the tongue causes surfaces of the tongue and the support to bear against each other, whereby an axially acting force is produceable to provide a clamping force for the tool.

10. A tool co-operating with a fixing device, said tool comprising:

a tool body in the form of a circular disk, with a central opening, and a radially inwardly facing locking surface, said fixing device which can be mounted on a machine tool or with which a machine tool is directly equipped;

said fixing device comprising at least one radially outwardly facing projection of a locking mechanism, which can be actuated manually and with which said fixing device can be releasably connected to said tool, wherein in the locking position the at least one radially outwardly facing projection of the fixing device engages over said radially inwardly facing locking surface of said tool, said tool body axially secured and held non-rotatably relative to the fixing device, wherein the at least one radially outwardly facing projection of the fixing device and a support on said fixing device are arranged axially displaceable relative to each other, wherein the axial displacement travel is blockable by a centrifugal force device, wherein the centrifugal force device comprises at least one radially displaceable tongue introducible into the axial displacement travel wherein the tongue and the support are axially displaceable relative to each other and wherein the radial displacement of the tongue causes surfaces of the tongue and the support to bear against each other, whereby an axially acting force is produceable to provide a clamping force for the tool.

11. A tool co-operating with a fixing device as set forth in claim 10 characterized in that the at least one radially outwardly facing projection and the support for the tool are arranged axially rotatably relative to each other.

12. A tool co-operating with a fixing device as set forth in claim 10 characterized in that there is provided an additional arresting device by which the tool can be secured non-rotatably with respect to the fixing device in the locking position.

13. A tool co-operating with a fixing device as set forth in claim 10 characterized by at least one arresting nose which extends axially and in the direction of the machine tool on a radially outwardly facing projection of the locking mechanism and which co-operates with an associated segment on the tool, providing the locking surface for affording a positively locking engagement between the projection and the segment in the locking position.

14. A tool co-operating with a fixing device as set forth in claim 13 characterized by two peripherally spaced such arresting noses for providing a pocket on the at least one radially outwardly facing projection of the fixing device, in which pocket the associated segment of the tool can be brought into a condition of positively locking engagement in the locking position.

15. A tool co-operating with a fixing device as set forth in claim 13 characterized by two peripherally spaced such arresting noses in that one of the arresting noses is adapted to transmit the drive force and the other arresting nose is adapted to transmit the inertia forces produced upon braking of the tool, wherein to provide a rotary abutment for the tool the former is of greater axial extent than the other arresting nose.

16. A tool co-operating with a fixing device as set forth in claim 10 characterized in that the at least one radially outwardly facing projection of the locking mechanism, in the locking position, is adapted to provide positively locking engagement with a segment of the tool, which affords an associated locking surface, wherein formed on the segment of the tool is a radially inwardly open pocket into which the projection can be introduced to provide the positively locking engagement.

17. A tool co-operating with a fixing device as set forth in claim 16 characterized in that at least one respective axial surface on the at least one radially outwardly facing projection in the locking position transmits the drive force and the inertia forces produced upon braking of the tool.

* * * * *